US007905587B2

(12) United States Patent
Matsumoto

(10) Patent No.: US 7,905,587 B2
(45) Date of Patent: Mar. 15, 2011

(54) LIQUID VESSEL AND METHOD OF MANUFACTURING THE SAME

(75) Inventor: Hitoshi Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 886 days.

(21) Appl. No.: 11/890,976

(22) Filed: Aug. 8, 2007

(65) Prior Publication Data

US 2008/0037910 A1 Feb. 14, 2008

(30) Foreign Application Priority Data

Aug. 8, 2006 (JP) ..... 2006-216110

(51) Int. Cl.
*B41J 2/175* (2006.01)

(52) U.S. Cl. ..... 347/86; 383/120; 222/107

(58) Field of Classification Search ..... 347/86; 383/120, 107, 108; 222/107, 92, 95; 59/700
See application file for complete search history.

(56) References Cited

U.S. PATENT DOCUMENTS 6,170,985 B1 * 1/2001 Shabram et al. ..... 383/100
6,220,702 B1 * 4/2001 Nakamura et al. ..... 347/86
6,467,652 B2 * 10/2002 Wilcox et al. ..... 222/95
7,677,712 B2 * 3/2010 Ishizawa et al. ..... 347/86
2004/0217127 A1 * 11/2004 Kimura et al. ..... 222/92
2005/0057625 A1 * 3/2005 Ishizawa et al. ..... 347/86
2005/0243149 A1 * 11/2005 Matsumoto ..... 347/86
2007/0272705 A1 * 11/2007 Beine et al. ..... 222/107
2010/0196797 A1 * 8/2010 Kimura et al. ..... 429/513

FOREIGN PATENT DOCUMENTS

JP 2005-059320 3/2005

* cited by examiner

*Primary Examiner* — Ellen Kim
(74) *Attorney, Agent, or Firm* — Nutter McClennen & Fish LLP; John J. Penny, Jr.

(57) ABSTRACT

Disclosed herein is a liquid vessel including a liquid lead-out portion for directing liquid out and a flexible liquid containing portion formed of a film for containing the liquid, wherein the liquid containing portion includes a first sealing portion having a body portion having a tubular shape formed by adhering both ends of one film to each other, a second sealing portion which includes gore portions having a pair of mountain-shaped folding portions folded at opposed side surfaces of the body portion in a longitudinal direction and a valley-shaped folding portion between the pair of mountain-shaped folding portion and seals an opening in a state in which the liquid lead-out portion is inserted into the opening of the body portion, and a third sealing portion which seals another opening of the body portion, and wherein the mountain-shaped folding portions configuring the gore portions have mountain-shaped maintenance portions which maintain a state in which inner surfaces of facing films at least partially contact each other.

15 Claims, 8 Drawing Sheets

LIQUID VESSEL AND METHOD OF MANUFACTURING THE SAME

BACKGROUND

1. Technical Field

The present invention relates to a liquid vessel having a liquid lead-out portion for ejecting liquid and a flexible liquid containing portion formed of a film for containing liquid, and a method of manufacturing the liquid vessel.

2. Related Art

There is a liquid ejecting apparatus which includes a liquid container and a liquid ejecting head, ejects liquid output from the liquid container from the liquid ejecting head, and discharges the liquid to a target which faces the liquid ejecting head. An example of such a liquid ejecting apparatus is an inkjet recording apparatus.

A variety of inkjet recording apparatuses including a carriage, a recording head functioning as a liquid ejecting head mounted in the carriage and an ink cartridge functioning as a liquid container have been developed.

Such inkjet recording apparatuses supply ink from the ink cartridge to the recording head and discharge the ink from a nozzle formed in the recording head, while the carriage is moved relative to the recording medium as a target, thereby performing printing with respect to the recording medium.

Among such inkjet recording apparatuses, there is a configuration in which the ink cartridge is not mounted in a carriage (called an off carriage type), in order to reduce load on the carriage or downsize the apparatus. Such an ink cartridge includes an ink pack for containing ink and a casing for containing the ink pack.

FIG. 11 is a conventional example of the ink pack.[1]

[1] FIGS. 11-14 should be labeled as "Conventional" or "Prior Art" if prior art under at least one section of 35 U.S.C. §102.

The ink pack 100 is disclosed in JP-A-2005-59320 and includes a cylindrical liquid lead-out portion 101 for ejecting ink and a flexible liquid containing portion 102 formed of a film for containing the ink.

The liquid lead-out portion 101 is formed of a hard resin material and has a valve tool which is mounted in an inkjet recording device and opens a flow path when an ink supply needle of the recording apparatus is inserted thereinto.

As shown in FIGS. 12 to 14, the liquid containing portion 102 has a vessel structure including a first sealing portion 121 obtained by welding both ends 111*c* and 111*d* of a film 111 including a lamination structure of a metal film 111*a* and a resin film 111*b* for a gas barrier property to each other to form a body portion 113, a gore portion 123 placed under tension in a circumferential direction of the body portion 113 at side surfaces thereof by a pair of mountain-shaped folding portions 115*a* and 115*b* folded at opposed side surfaces of the body portion 113 in a longitudinal direction and a valley-shaped folding portion 116 between the pair of mountain-shaped folding portions 115*a* and 115*b*, a second sealing portion 125 for sealing an opening 113*a* of the body portion 113 in a state in which the liquid lead-out portion 101 is inserted into the opening 113*a* of one side of the body portion 113, and a third sealing portion 127 for sealing an opening 113*b* of the other side of the body portion 113.

The sealing portions 121, 125 and 127 are sealed by thermal welding in a state in which the surfaces of the resin films 111*b* of the film 111 overlap with each other.

However, in an inkjet recording apparatus for business use, in order to reduce the replacement frequency of the ink pack 100 due to an ink shortage to improve the operation rate of the apparatus, a large-capacity ink pack 100 is required.

If the capacity of the ink pack 100 is increased, rigidity of the liquid containing portion 102 needs to be increased by thickening the film 111 in order to prevent the film 111 from being damaged due to low strength.

However, a liquid containing portion 102 having high rigidity due to thickening of the film 111 is difficult to deform due to a restoring force of the film 111 which may cause inconvenience.

For example, in the conventional ink pack 100, since the liquid containing portion 102 before use is completely filled with ink, as shown in FIG. 15, the gore portion 123 perfectly expands such that the pair of mountain-shaped folding portions 115*a* and 115*b* are unfolded so that internal angles thereof are close to about 90 degrees. Then, the gore portion 123 is difficult to fold even when storage amount is reduced by the consumption of the ink. When the liquid containing portion 102 is pressurized from the outside by pressurized air such that the ink in the liquid containing portion 102 is supplied from the liquid lead-out portion 101 to the recording apparatus, the peripheral portion of the gore portion 123 is difficult to crush. Thus, there is a problem that the amount of residual ink is increased.

If the film 111 used in the liquid containing portion 102 is thinned in order to prevent the above-described problem from occurring, for example, the ink is shaken at the time of transport and the gore section is repeatedly bent. In this case, cracking occurs in the metal film 111*a* configuring the film 111, the gas barrier property of the liquid containing portion 102 is reduced, and the storage property of the stored ink deteriorates.

SUMMARY

An advantage of at least one embodiment of the invention is that it provides a liquid vessel capable of preventing a folding property of a gore portion from being impaired even though a film used in a liquid containing portion is thickened such that the amount of residual liquid can be reduced.

According to an aspect of at least one embodiment of the invention, there is provided a liquid vessel including a liquid lead-out portion for ejecting liquid out and a flexible liquid containing portion formed of a film for containing the liquid, wherein the liquid containing portion includes a first sealing portion having a body portion having a tubular shape formed by adhering both ends of one film to each other, a second sealing portion which includes gore portions having a pair of mountain-shaped folding portions folded at opposed side surfaces of the body portion in a longitudinal direction and a valley-shaped folding portion between the pair of mountain-shaped folding portion that seals an opening in a state in which the liquid lead-out portion is inserted into the opening of the body portion, and a third sealing portion that seals another opening of the body portion, and wherein the mountain-shaped folding portions configuring the gore portions have mountain-shaped maintenance portions which maintain a state in which inner surfaces of facing films at least partially contact each other.

By this configuration, since the liquid is completely filled in the liquid containing portion before use, the gore portions completely expand, but the pair of mountain-shaped folding portions of the gore portions has a state at the time of folding by providing the mountain-folding-shape maintenance portions. Accordingly, a folding property of the gore portions is not impaired. Accordingly, when the liquid containing portion is pressurized from the outside by pressurized air such that the liquid in the liquid containing portion is supplied from the liquid lead-out portion to a liquid ejecting apparatus and the amount of contained ink is reduced, the gore sections are rapidly shrunken.

That is, a folding property of the gore portions is not impaired although a thick film is used in the liquid containing portion in order to increase the amount of contained liquid. In addition, since the liquid containing portion is difficult to be crushed, the amount of residual ink can be reduced.

The mountain-shaped maintenance portions may be formed by welding the inner surfaces of the facing films to each other.

By this configuration, since a dedicated component is not required for forming the mountain-folding-shape maintenance portions, the structure of the pair of mountain-shaped folding portions configuring the gore portions is simplified and thus cost can be reduced.

The mountain-shaped maintenance portions may be intermittently formed in a longitudinal direction of the mountain-shaped folding portion.

By this configuration, since the mountain-shaped maintenance portions can be formed by spot-welding the inner surfaces of the facing films, the workability of the mountain-shaped maintenance portions can be improved and the productivity of the liquid containing portion can be improved. Compared with the case where continuous welding is performed, the output of a welding device is reduced and equipment cost and process cost can be reduced.

Both ends of the mountain-shaped folding portions configuring the gore portions each may be formed in a triangular shape in which a contact area between the inner surfaces of the facing films is gradually widened.

By this configuration, since the inner surfaces of the facing film contact each other at both ends of the longitudinal direction of the pair of mountain-shaped folding portions configuring the gore portions, the gore portions are gradually folded from both ends of the longitudinal direction when the amount of liquid contained in the liquid containing portion is reduced, such that an operation for folding the gore portions is smoothly performed.

The contained liquid may be ink and the liquid vessel may be mounted in an inkjet recording apparatus to be used as an ink vessel for supplying the ink to the recording apparatus.

By this configuration, since the liquid containing portion is adequately crushed in accordance with the consumption of the ink contained in the liquid containing portion, the amount of residual ink due to the deformation which occurs due to the crush of the gore sections 36 is minimized and printing cost of the inkjet recording apparatus can be reduced.

According to another aspect of at least one embodiment of the invention, there is provided a method of manufacturing a liquid vessel, the method including: forming gore portions by forming a pair of mountain-shaped folding portions folded in a longitudinal direction at opposed side surfaces of a body portion having a tubular shape obtained by adhering both ends of one film to each other and forming a valley-shaped folding portion between the pair of mountain-shaped folding portions; forming mountain-shaped maintenance portions which maintain a state in which inner surfaces of facing films at least partially contact each other; sealing an opening in a state in which a liquid lead-out portion for directing liquid out is inserted into the opening of the body portion; filling the liquid in a vessel portion formed by sealing the opening; and sealing another opening of the body portion in a state in which the liquid is filled in the vessel portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, liquid vessels according to embodiments of the invention will be described in detail with reference to the accompanying drawings.

Figure 1:
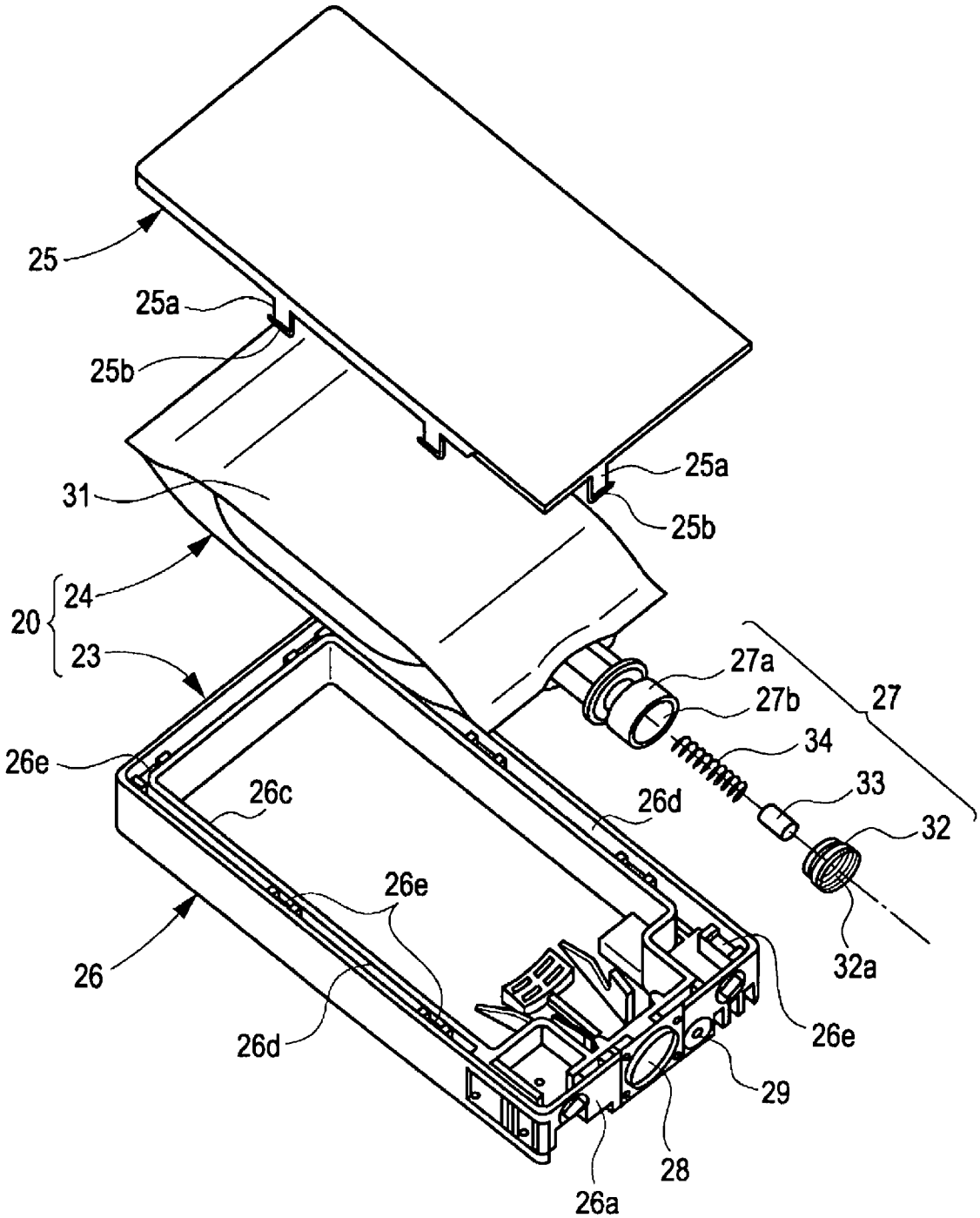
FIG. 1 is an exploded perspective view of an ink cartridge used in an ink pack of a liquid vessel according to a first embodiment of the invention.
Figure 2:
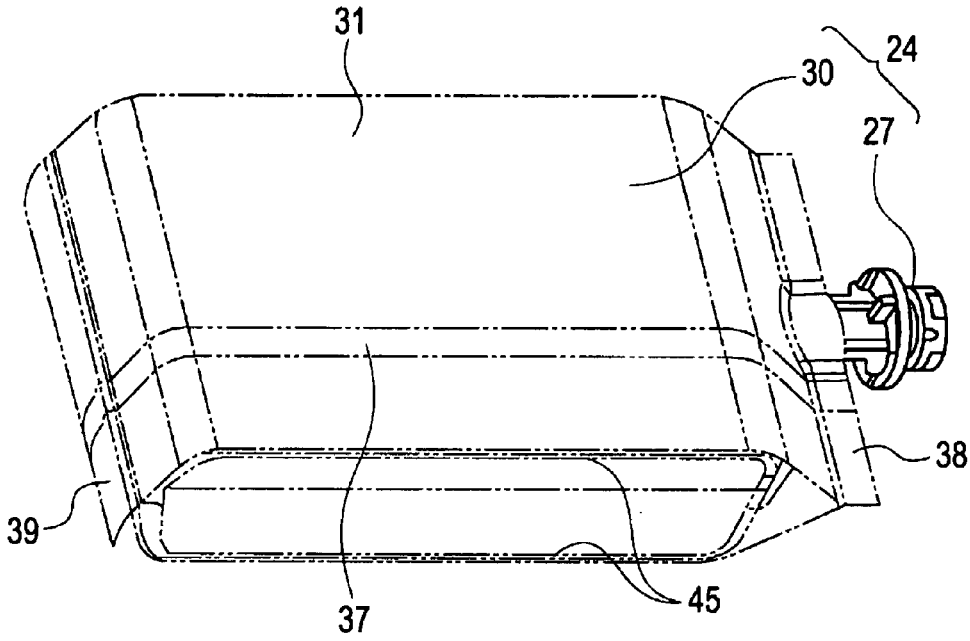
FIG. 2 is a perspective view of the ink pack shown in FIG. 1.

FIG. 1 is an exploded perspective view of an ink cartridge used in an ink pack of a liquid vessel according to a first embodiment of the invention.

The ink cartridge 20 shown in FIG. 1 includes a casing 23 which is detachably mounted in a cartridge mounting portion of an inkjet recording apparatus (not shown) and an ink pack 24 contained in the casing 23.

The casing 23 includes a cover 25 and a body casing 26.

The body casing 26 has a box shape with an open upper surface. A support port 28 is formed in a front surface 26*a* of the body casing 26, and the support port 28 communicates the inside and the outside of the body casing 26 with each other. A pressurization air lead-in port 29 connected to a pressurization air supply device of a recording apparatus is formed in the front surface 26*a* of the body casing 26 on the right side of the support port 28. The pressurization air lead-in port 29 communicates the inside and the outside of the body casing 26 with each other.

The pressurization air lead-in port 29 is connected to the pressurization air supply device provided in the cartridge mounting portion and functions as a flow path for directing pressurized air into a gap between the casing 23 and the ink pack 24, when the ink cartridge 20 is mounted in the cartridge mounting portion of the recording apparatus (not shown). The pressurization air lead-in port 29 is opened to communicate with the atmosphere such that the ink pack 24 is not pressurized by an internal pressure variation of the casing 23, when the ink cartridge 20 is not mounted in the cartridge mounting portion.

In the body casing 26, a partition wall 26*c* configuring a closed space for pressurizing the ink pack 24 is provided.

The partition wall 26*c* is formed on a bottom surface of the body casing 26 separated from the inner surface of the body casing 26 with a small interval therebetween, has an opened upper surface, and has a portion protruding toward the front surface 26*a* of the casing 23. The partition wall 26*c* supports the ink pack 24 contained therein.

The pressurization air lead-in port 29 is opened in the inner surface of the partition wall 26*c*. An upper end surface of the partition wall 26*c* in which the ink pack 24 is contained is adhered to a film (not shown).

A space defined by the partition wall 26*c*, the bottom surface of the body casing 26 and the film is sealed in a closed state. Pressurized air supplied from the pressurization air supply device of the recording apparatus is directed into the space through the pressurization air lead-in port 29.

A groove 26*d* is formed between the inner surface of the body casing 26 and the outer surface of the partition wall 26*c*. A plurality of engagement portions 26*e* are formed in the groove 26*d*.

The first engagement portions 26*e* are mounted between the partition wall 26*c* and the body casing 26 and have a rod-shaped or U-shaped cross section.

The cover 25 is a rectangular parallelepiped plate shape and has second engagement portions 25*a* protruding from the cover 25 downward at the edges thereof.

The second engagement portions 25*a* include pawls 25*b* at the front ends thereof. The pawls 25*b* protrude from the cover 25 outwardly and are formed so as to be engage with the first engagement portions 26*e* provided in the groove 26*d* of the body casing 26. The cover 25 covers the opening of the body casing 26 in a state in which the ink pack 24 is contained in the partition wall 26*c* and the film is adhered to the partition wall 26*c*.

Next, the ink pack 24 of the liquid vessel according to a first embodiment of the invention will be described with reference to FIG. 1 and FIGS. 2 to 8.

The ink pack 24 according to the present embodiment includes a vessel portion 31 as a body portion configuring the liquid containing portion 30 for containing ink as liquid. A supply member 27 protrudes from one side of the vessel portion 31 as a liquid lead-out portion.

Figure 3:
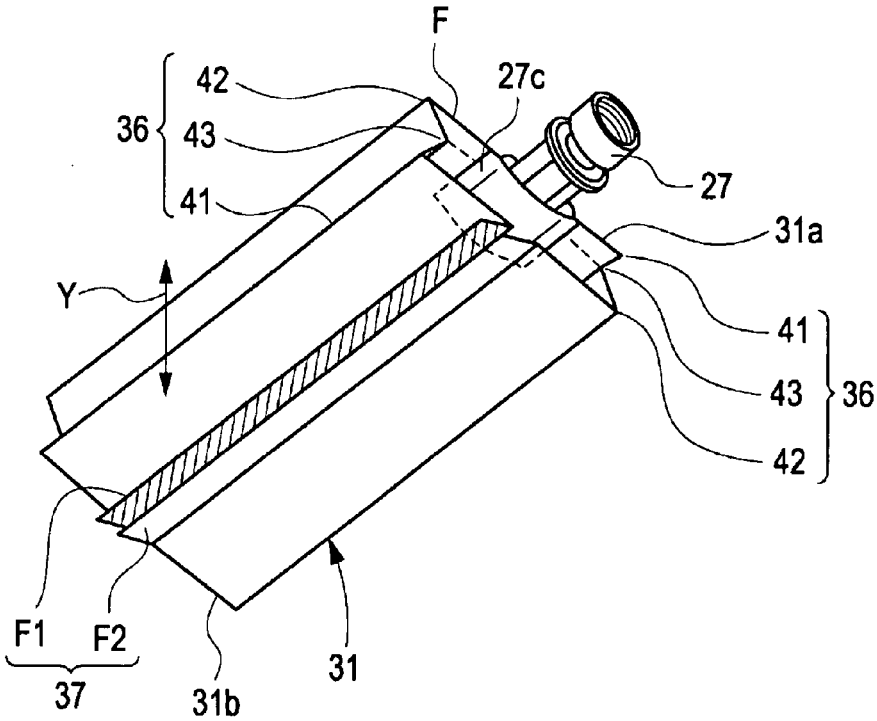
FIG. 3 is a perspective view showing a method of manufacturing a liquid containing portion of the ink pack shown in FIG. 2.

As shown in FIGS. 1 and 3, the supply member 27 includes a main body 27*a* formed of resin such as polypropylene, and a supply hole 27*b* for directing the ink out formed in the main body 27*a*.

One side of the main body 27*a* protrudes from the vessel portion 31, and an ink ejection port (not shown) formed at the other side thereof is located in the vessel portion 31. A flat supply member welding portion 27*c* (see FIG. 3) is adhered to the vessel portion 31 in a plane direction of the vessel portion 31.

A seal member 32 is fitted into the front end of the main body 27*a* protruding from the vessel portion 31. A supply hole 32*a* for directing the ink out is formed in the center of the seal member 32. A spring washer 33 and a coil spring 34 are provided in the supply hole 27*b* of the main body 27*a* at the inside of the seal member 32.

The coil spring 34 urges the spring washer 33 toward the seal member 32 such that the spring washer 33 closes the supply hole 32*a* of the seal member 32.

When the ink cartridge 20 is provided in the cartridge mounting portion, an ink supply needle (not shown) provided at a predetermined position of the cartridge mounting portion passes through the seal member 32 in the supply member 27 and the spring washer 33 is forced toward the vessel portion 31 against an elastic force of the coil spring 34. When the spring washer 33 is forced toward the vessel portion 31 and is separated from the seal member 32, the ink in the vessel portion 31 flows out through a gap between the seal member 32 and the spring washer 33.

Figure 5:
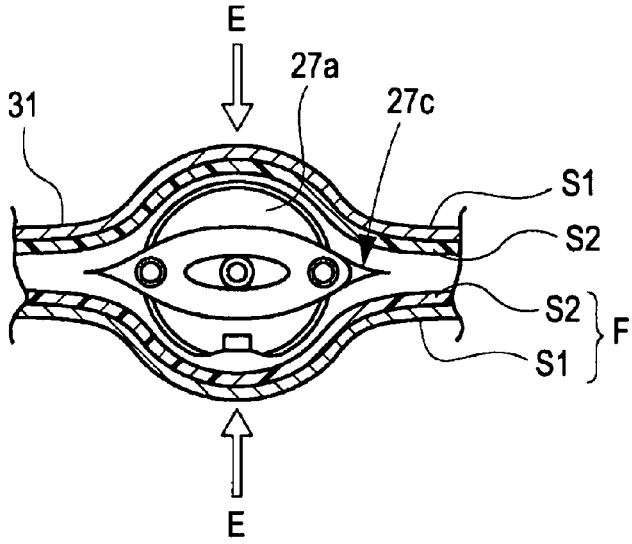
FIG. 5 is a cross-sectional view taken along line V-V of FIG. 4.
Figure 6:
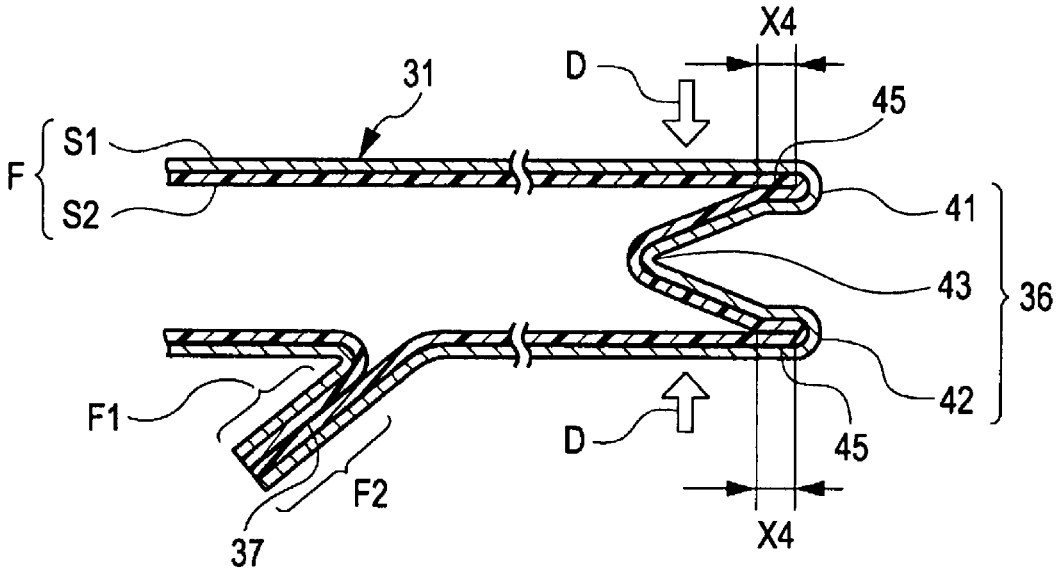
FIG. 6 is a cross-sectional view taken along line VI-VI of FIG. 4.

As shown in FIGS. 5 and 6, the vessel portion 31 in which the supply member 27 is mounted includes a film F obtained by laminating a plurality of layers. The film F includes a gas barrier layer S1 obtained by laminating a plurality of layers such as nylon or aluminum and a resin layer S2 obtained by laminating a plurality of thermoplastic resin layers such as polypropylene or polyethylene. The resin layer S2 is formed of a material which can be thermally adhered to the main body 27*a* of the supply member 27.

As shown in FIGS. 3 and 6, the vessel portion 31 includes a first welding portion 37 formed by folding one film F into a tubular shape in a state in which the gas barrier layer S1 is placed outside and thermally welding the inner surfaces (resin layers S2) of both ends F1 and F2 to each other.

Figure 4:
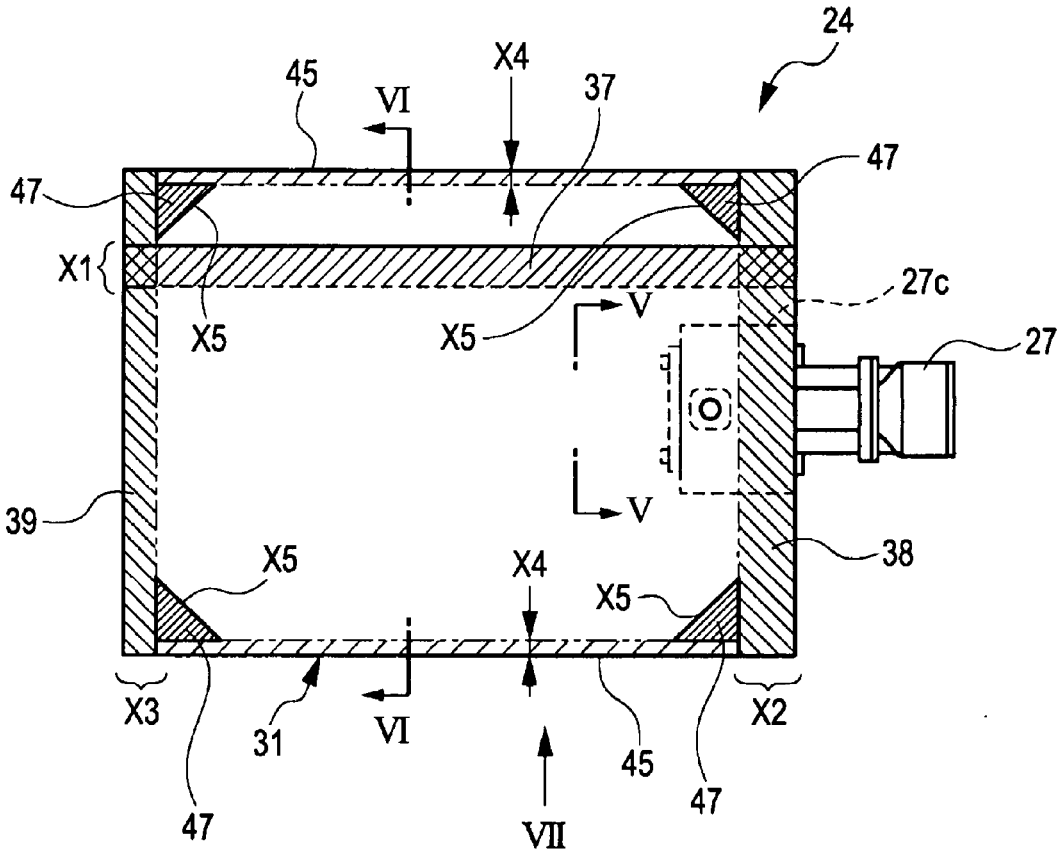
FIG. 4 is a plan view showing the method of manufacturing the liquid containing portion of the ink pack shown in FIG. 2.

As denoted by a first hatched region X1 of FIG. 4, the first welding portion 37 is provided in a longitudinal direction of the vessel portion 31 and is folded from a base end to overlap an adjacent film surface. The first welding portion 37 corresponds to a first sealing portion of the claims.

The vessel portion 31 includes a second welding portion for sealing one opening 31*a* (see FIG. 3) having a tubular shape with the supply member 27 interposed therebetween and a third welding portion 39 for sealing the other opening 31*b* which is a bottom portion of the vessel portion 31.

As denoted by a second hatched region X2 of FIG. 4, the second welding portion 38 adheres the inner surfaces of the facing films at the side of the opening 31*a* of the vessel portion 31 and corresponds to the second sealing portion of the claims.

As denoted by a third hatched region X3 of FIG. 4, the third welding portion 39 adheres the inner surfaces of the facing films at the side of the opening 31*b* of the vessel portion 31 and corresponds to the third sealing portion of the claims.

As shown in FIG. 3, both side surfaces of the vessel portion 31 have gore portions 36 formed by folding the film F before forming the second welding portion 38 and the third welding portion 39.

The gore portions 36 are placed under tension in a thickness direction (an arrow direction Y) of the rectangular parallelepiped vessel portion 31 by a pair of mountain-shaped folding portions 41 and 42 folded at opposed side surfaces of the vessel portion 31 in a longitudinal direction and a valley-shaped folding portion 43 between the pair of mountain-shaped folding portions 41 and 42.

The gore portions 36 are formed at positions which do not overlap the first welding portion 37 at the opposed side surfaces of the vessel portion 31.

As shown in FIG. 6, the pair of mountain-shaped folding portions 41 and 42 configuring the gore sections 36 have mountain-shaped maintenance portions 45 for maintaining the state in which the inner surfaces of the facing films contact each other.

In the present embodiment, the mountain-shaped maintenance portions 45 are continuously formed over the entire length of the longitudinal direction of the vessel portion 31 by thermally welding the inner surfaces of the facing films to each other, as denoted by a fourth hatched region X4 of FIG. 4.

In the present embodiment, at both ends of the longitudinal direction of the pair of mountain-shaped folding portions 41 and 42 configuring the gore portions 36, as shown in FIG. 4, second mountain-shaped maintenance portions 47 are each formed in a triangular shape in which a contact area is gradually widened toward one end thereof.

The second mountain-shaped maintenance portions 47 are formed by thermally welding the inner surfaces of the facing films to each other in the triangular shape denoted by a fifth hatched region X5 of FIG. 4, similar to the above-described mountain-shaped maintenance portions 45.

Next, the method of manufacturing the liquid vessel will be described.

When the film F is formed in the tubular shape, as shown in FIG. 6, the gas barrier layer S1 is heated by inserting both ends F1 and F2 into a crimping tool (not shown) in a state in which the film is bent in the tubular shape such that the gas barrier layer S1 is placed outside. The resin layers S2 of the ends F1 and F2 are melted by heating and the ends F1 and F2 are adhered to each other by solidifying the molten resin, thereby forming the first welding portion 37.

The film F having the tubular shape is pressed in a mold (not shown) such that a plurality of folding lines (the pair of mountain-shaped folding portions 41 and 42 and the valley-shaped folding portion 43) configuring the gore section 36 are formed at the opposed side surfaces of the vessel portion 31 in the longitudinal direction. Accordingly, two gore portions 36 are formed in the film F having the tubular shape.

As shown in FIG. 6, the gore portions are formed to have a cross section having substantially an M shape. The first welding portion 37 is provided between the gore portions 36. That is, the first welding portion 37 is provided at a position spaced apart from the gore portions 36.

The edges of the mountain-shaped folding portions 41 and 42 formed as the gore portions 36 are inserted into the crimping tool and the contacted resin layers S2 are adhered such that the mountain-shaped maintenance portions 45 are formed as shown in FIG. 6.

Next, in a state in which the seal member 32 of the supply member 27 protrudes from the vessel portion 31 and the supply member welding portion 27*c* located at an opposite side is inserted into the vessel portion 31, the opening 31*a* of the film F having the tubular shape is pressed by the crimping tool in an arrow direction E of FIG. 5 and is heated such that the opening 31*a* is thermally sealed. Accordingly, the second welding portion 38 shown as the second hatched region X2 of FIG. 4 is formed.

At this time, both sides of the vessel portion 31 are formed of four-layer films F as shown in FIG. 6. Both sides of the vessel portion 31 are inserted into the crimping tool having a contact region having a triangular shape and the film F is pressed in an arrow direction D and is heated, thereby forming the second mountain-shaped maintenance portions 47 shown as the fifth hatched region X5 of FIG. 4.

The ink is filled in the vessel portion 31 through the other opening 31 at a time when one opening 31*a* of the film F is sealed.

After the ink is filled in the vessel portion 31, the other opening 31*b* of the film F having the tubular shape is heated and sealed by the crimping tool to become the third welding portion 39. Accordingly, the third welding portion 39 shown by the third hatched region X3 of FIG. 4 is formed.

The ink pack 24 sealed by the thermal welding is contained in the body casing 26 in a state in which the first welding portion 37 is placed downward and the supply member 27 passes through the support port 28 of the body casing 26. The cover 25 is engaged with the body casing 26 in a state in which the above-described film is adhered to the partition wall 26*c*, thereby sealing the body casing 26.

Figure 8:
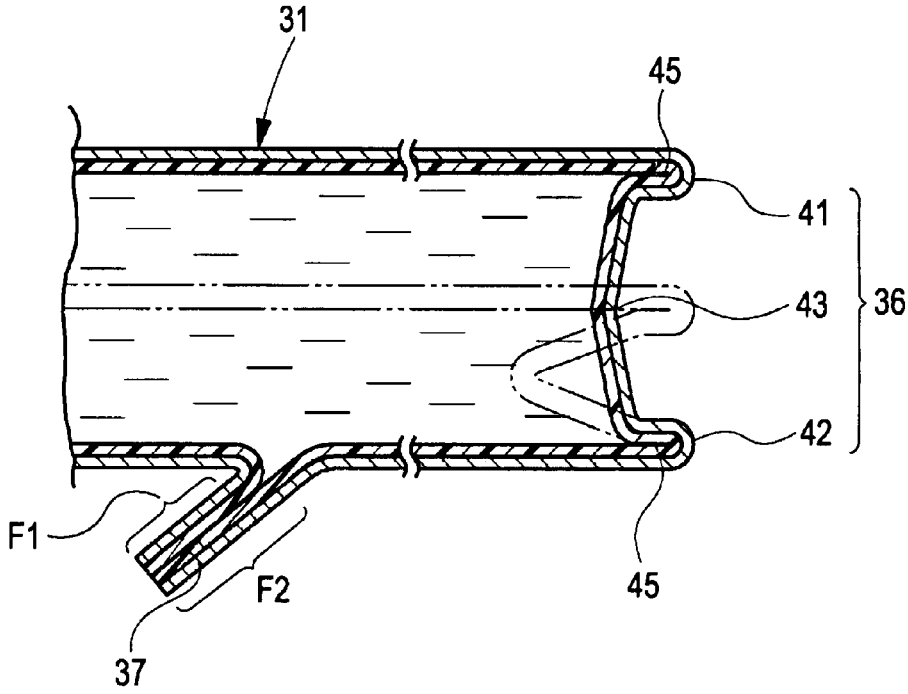
FIG. 8 is a view explaining an operation of a gore portion shown in FIG. 6.

In the above-described ink pack 24, the ink is completely filled in the liquid containing portion 30 before use (at the time of completion of initial charge of the ink). Accordingly, as shown in FIG. 8, the gore portions 36 of the both side surfaces of the liquid containing portion 30 completely expand, but the pair of mountain-shaped folding portions 41 and 42 of the gore portions 36 are in a contact state at the time of folding by providing the mountain-shaped maintenance portions 45. Accordingly, a folding property of the gore portions 36 is not impaired by the restoring force of the vessel portion 31. Accordingly, when the liquid containing portion 30 is pressurized from the outside by pressurized air such that the ink in the liquid containing portion 30 is supplied from the supply member 27, which is the liquid lead-out portion, to the inkjet recording apparatus and the amount of contained ink is reduced, the liquid containing portion is compressed according to the reduction of the amount of ink and thus the gore sections 36 are rapidly shrunken.

That is, the folding property of the gore portions 36 is not impaired even though the film used in the liquid containing portion 30 is made thicker in order to increase the amount of contained ink. In addition, since the liquid containing portion 30 is difficult to crush, the amount of residual ink can be reduced.

Since the liquid containing portion 30 is adequately crushed in accordance with the consumption of the ink contained in the liquid containing portion 30, the amount of residual ink due to the deformation which occurs due to the crushing of the gore sections 36 is minimized and the printing cost of the inkjet recording apparatus can be reduced.

In the ink pack 24 according to the present embodiment, the mountain-shaped maintenance portions 45 are formed in the pair of mountain-shaped folding portions 41 and 42 configuring the gore portions 36 of the liquid containing portion 30. The mountain-shaped maintenance portions 45 are formed by welding the inner surfaces of the facing films to each other. Accordingly, since a dedicated component is not required for forming the mountain-shaped maintenance portions 45, the structure of the pair of mountain-shaped folding portions configuring the gore portions is simplified and thus process cost can be reduced.

In the ink pack 24 according to the present embodiment, at both ends of the longitudinal direction of the pair of mountain-shaped folding portions 41 and 42 configuring the gore portions 36, the second mountain-shaped maintenance portions 47 for maintaining the state in which the inner surfaces of the facing films contact each other are each formed in a triangular shape in which a contact area is gradually widened toward one end thereof.

Figure 7:
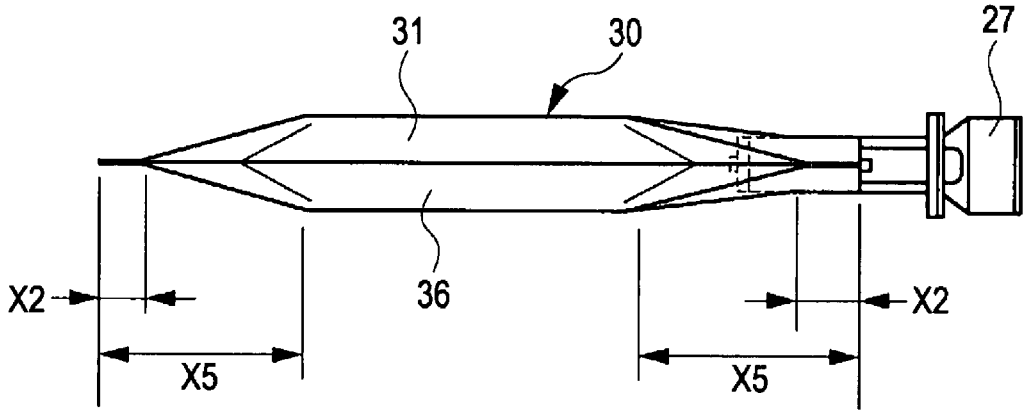
FIG. 7 is a perspective view when viewed in a direction VII of FIG. 4.

Accordingly, as shown in FIG. 7, since the ink is contained such that the volume is gradually reduced in the vicinity of both ends of the longitudinal direction of the liquid containing portion 30, and the inner surfaces of the facing film contact each other at both ends of the longitudinal direction of the pair of mountain-shaped folding portions 41 and 42 configuring the gore portions 36, the gore portions 36 are gradually folded from both ends of the longitudinal direction when the amount of liquid contained in the liquid containing portion 30 is reduced, such that an operation for folding the gore portions 36 is smoothly performed.

Although a configuration for forming the gore portions 36 at a position which does not overlap the first welding portion 37 is described in the first embodiment, the first welding portion 37 may be applied as one of the pair of mountain-shaped folding portions 41 and 42 of the gore portions 36. In this case, the number of thermal welding processes is reduced to increase productivity and the first welding portion 37 is substantially removed from the surface of the vessel portion 31 to improve a design property.

In the liquid vessel according to the invention, the configuration of the mountain-shaped maintenance portions 45 of the pair of mountain-shaped folding portions 41 and 42 is not limited to the configuration in which the mountain-shaped maintenance portions 45 are continuously formed over the entire length of the longitudinal direction of the vessel portion 31 in the first embodiment.

Figure 9:
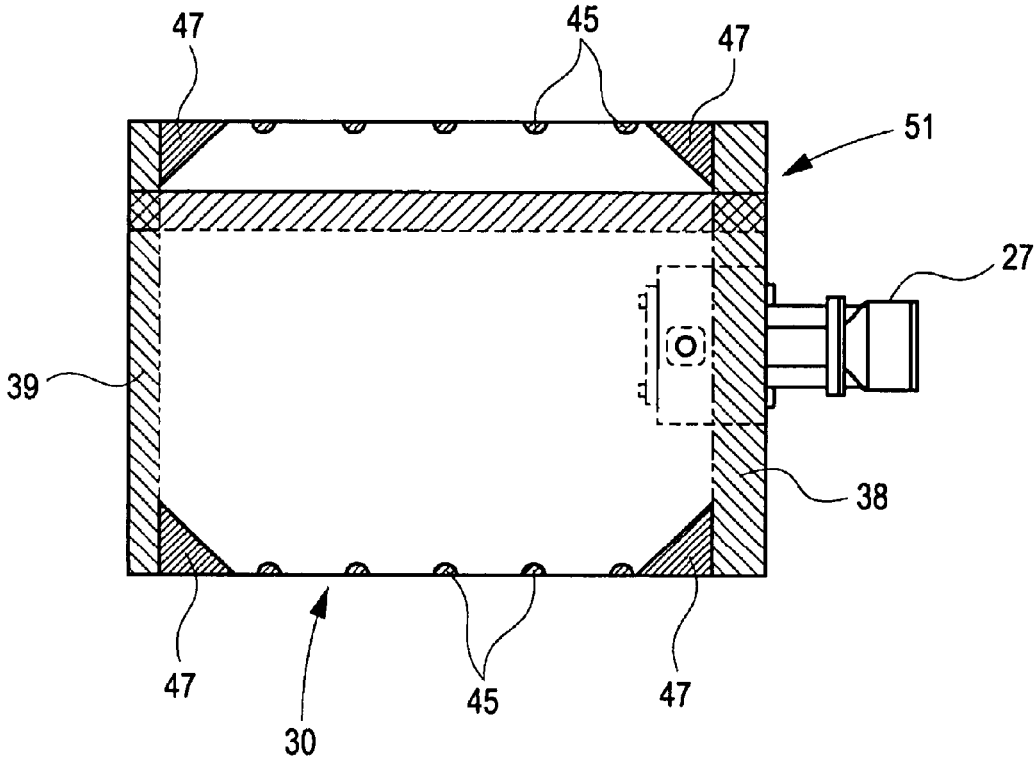
FIG. 9 is a plan view of an ink pack of a liquid vessel according to a second embodiment of the invention.

FIG. 9 is a plan view of an ink pack of a liquid vessel according to a second embodiment of the invention.

In an ink pack 51 according to the second embodiment, the mountain-shaped maintenance portions 45 of the pair of mountain-shaped folding portions 41 and 42 (see FIG. 3) of the liquid containing portion 30 are intermittently formed in the longitudinal direction of the mountain-shaped folding portions 41 and 42 at a predetermined interval. Since the mountain-shaped maintenance portions 45 can be formed by spot-welding the inner surfaces of the facing films, the workability of the mountain-shaped maintenance portions 45 can be improved and the productivity of the liquid containing portion 30 can be improved. Compared with the case where continuous welding is performed, the output of a welding device is suppressed and equipment cost and process cost can be reduced.

The predetermined interval is an interval which allows the contact state at the time of folding to be maintained in the mountain-shaped folding portions 41 and 42 of the gore sections 36 to prevent the folding property from being impaired when the gore portions 36 are folded in accordance with the consumption of ink. Alternatively, the mountain-shaped maintenance portions may be formed at places which are difficult to be folded at the time of compression according to the reduction of the amount of ink contained in the ink pack 51 as substantially a middle portion of the longitudinal direction of the mountain-shaped folding portions 41 and 42.

The method of forming the mountain-shaped maintenance portions according to the invention is not limited to the thermal welding according to the above-described embodiment.

Figure 10:
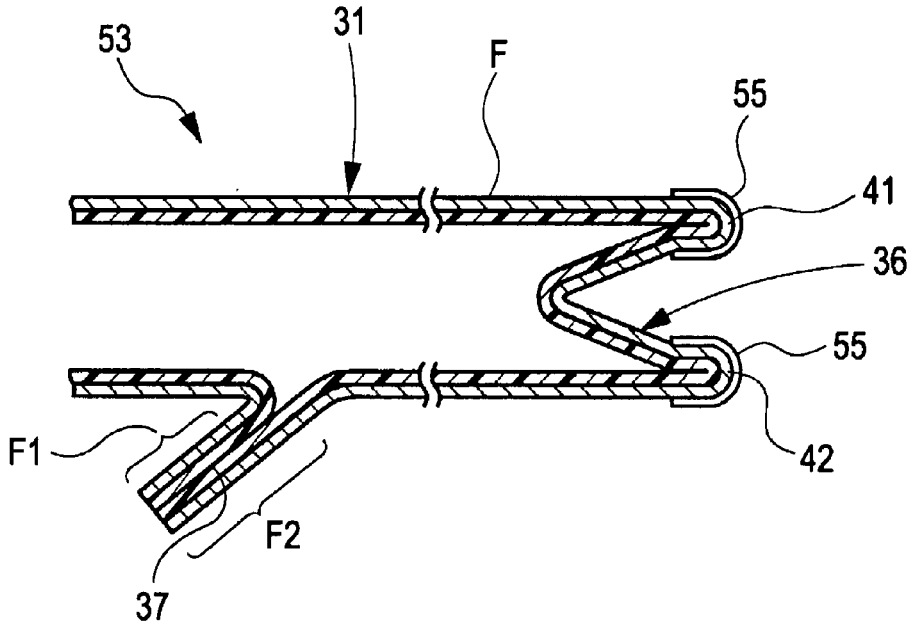
FIG. 10 is a cross-sectional view of main portions of an ink pack of a liquid vessel according to a third embodiment of the invention.
Figure 11:
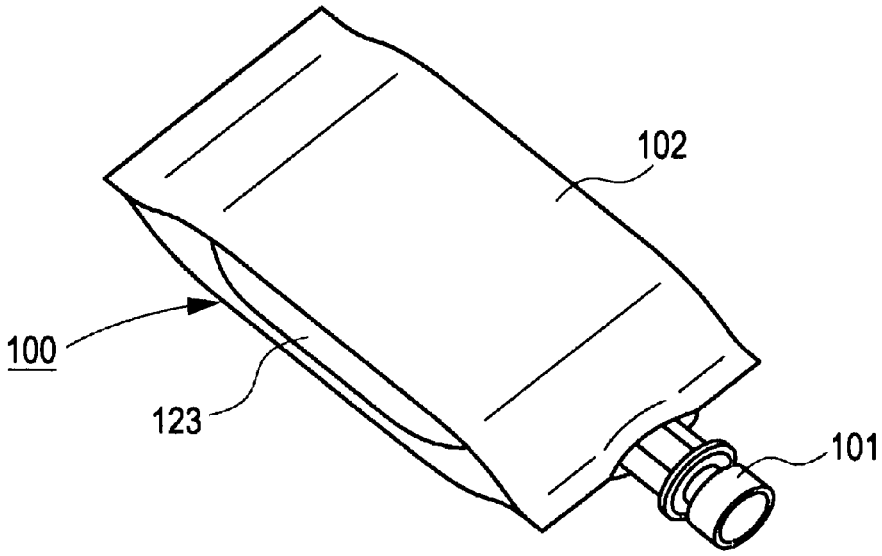
FIG. 11 is a perspective view of an ink pack as a known liquid vessel.
Figure 12:
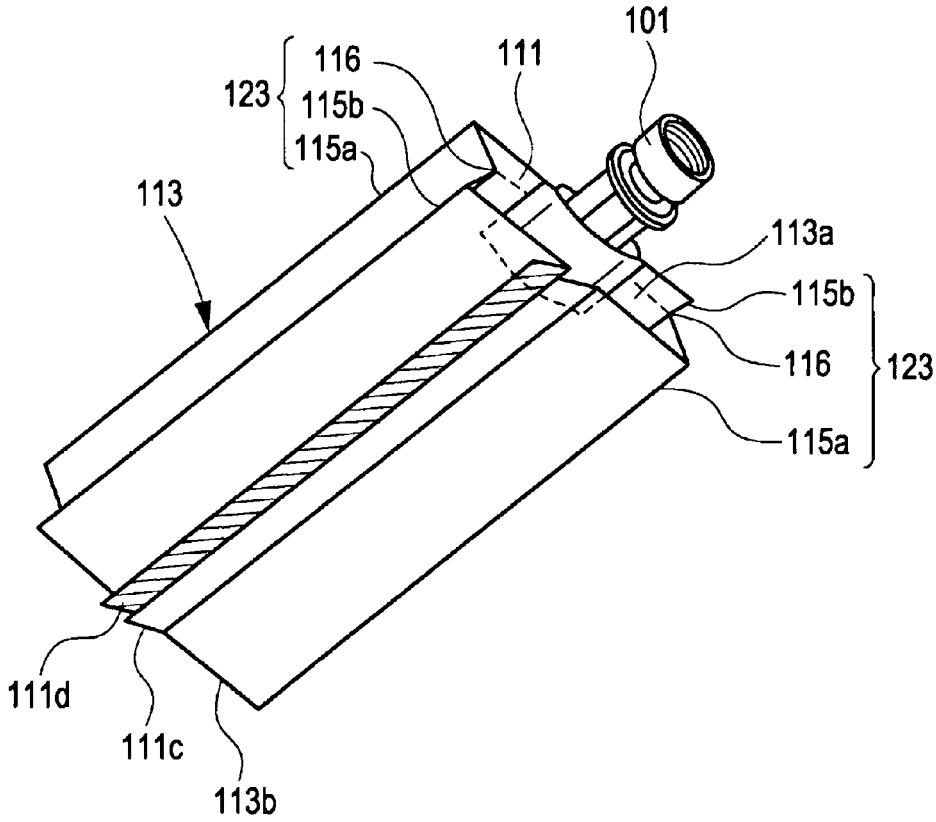
FIG. 12 is a perspective view showing a method of manufacturing a liquid containing portion of the ink pack shown in FIG. 11.
Figure 13:
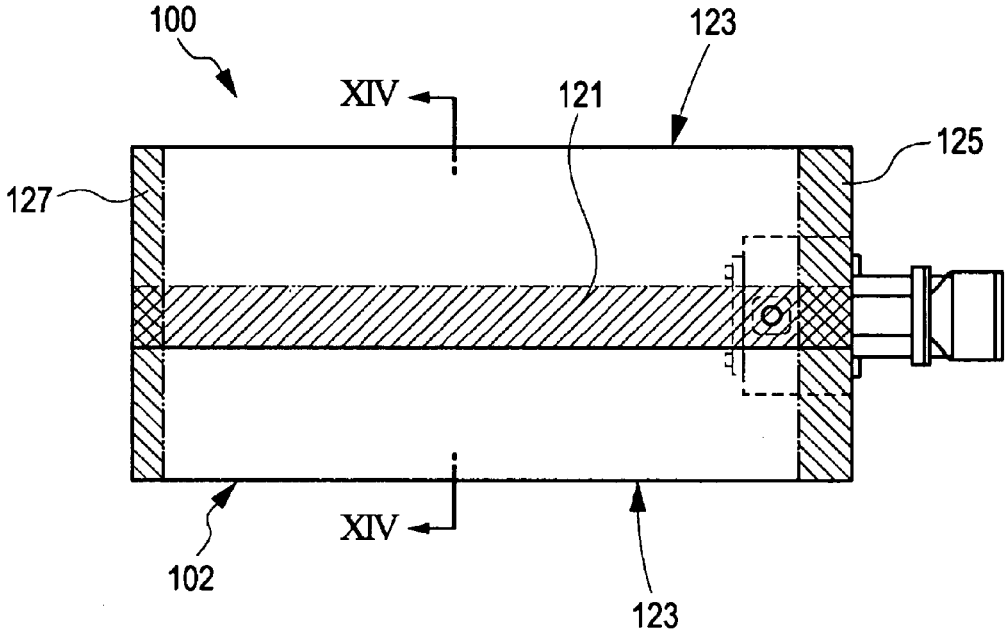
FIG. 13 is a plan view showing the method of manufacturing the liquid containing portion of the ink pack shown in FIG. 11.
Figure 14:
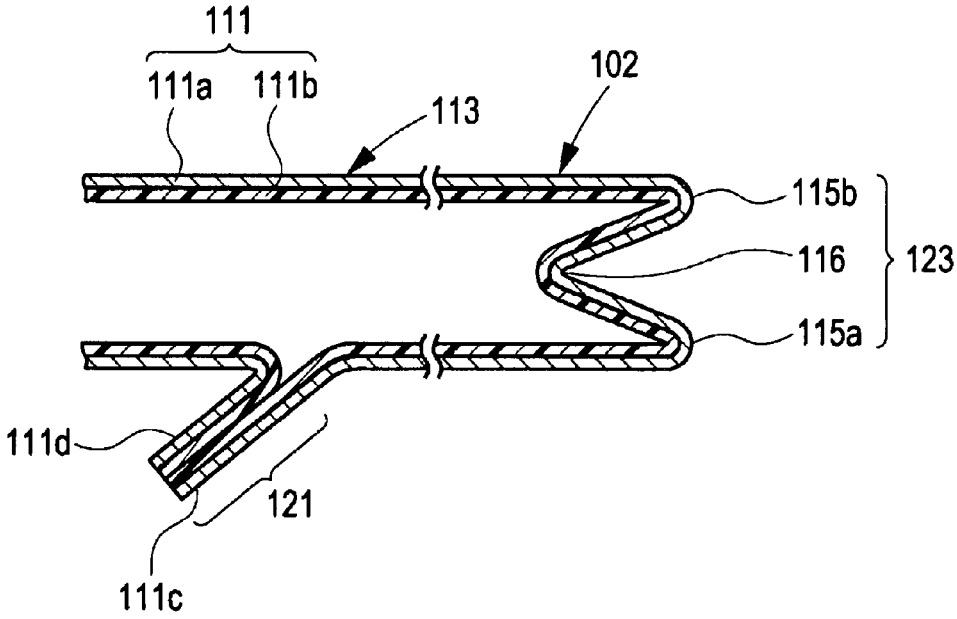
FIG. 14 is a cross-sectional view taken along line XIV-XIV of FIG. 13.
Figure 15:
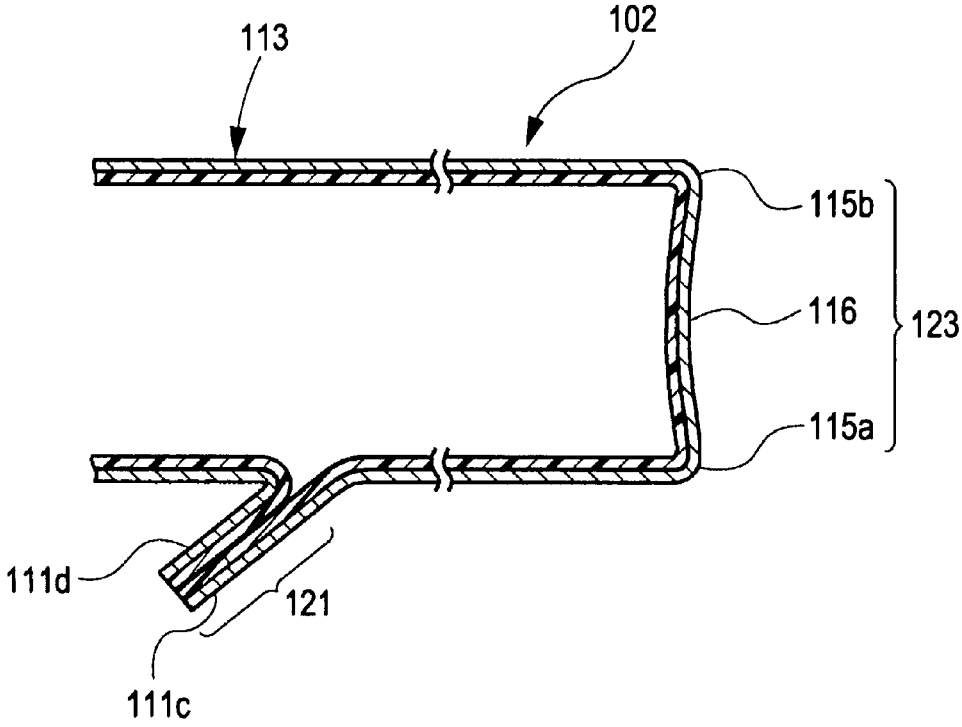
FIG. 15 is a view explaining a problem of the ink pack shown in FIG. 11.

FIG. 10 is a cross-sectional view of main portions of an ink pack of a liquid vessel according to a third embodiment of the invention.

In an ink pack 53, clips 55 are fitted to the pair of mountain-shaped folding portions 41 and 42 configuring the gore portions 36 in a state in which the inner surfaces of the facing films contact to each other and the clips 55 function as the mountain-shaped maintenance portions 45.

Since the thermal welding is not used, it is possible to increase a freedom degree of the method of manufacturing the ink pack 53.

Although the gore portion has the pair of mountain-shaped folding portions and the valley-shaped folding portion between the pair of mountain-shaped folding portions in the above-described embodiments, the invention is not limited to the configuration. The number of mountain-shaped folding portions may be more than three and the number of valley-shaped folding portions may be more than two (number of mountain-shaped folding portions−1).

Although the printer 11 for discharging the ink is described as a liquid ejecting apparatus in the embodiments, other liquid ejecting apparatuses may be used. For example, a liquid ejecting apparatus for ejecting liquid, an electrode material or a color material used in a printing apparatus including a facsimile machine or copier, a liquid crystal display, an electroluminescence (EL) display, or surface light-emitting display, a liquid ejecting apparatus for ejecting a bioorganic material used for manufacturing a bio chip, or an apparatus for ejecting a sample as a precise pipette may be used. The fluid (liquid) is not limited to ink and other fluid (liquid) may be used.

What is claimed is:

1. A liquid vessel comprising a liquid lead-out portion for directing liquid out and a flexible liquid containing portion formed of a film for containing the liquid, wherein the liquid containing portion includes a first sealing portion having a body portion having a tubular shape formed by adhering both ends of one film to each other, a second sealing portion which includes gore portions having a pair of mountain-shaped folding portions folded at opposed side surfaces of the body portion in a longitudinal direction and a valley-shaped folding portion between the pair of mountain-shaped folding portion and seals an opening in a state in which the liquid lead-out portion is inserted into the opening of the body portion, and a third sealing portion which seals another opening of the body portion, and wherein the mountain-shaped folding portions configuring the gore portions have mountain-shaped maintenance portions which maintain a state in which inner surfaces of facing films at least partially contact each other.

2. The liquid vessel according to claim 1, wherein the mountain-shaped maintenance portions are formed by welding the inner surfaces of the facing films to each other.

3. The liquid vessel according to claim 2, wherein the mountain-shaped maintenance portions are intermittently formed in a longitudinal direction of the mountain-shaped folding portions.

4. The liquid vessel according to claim 1, wherein at both ends of the mountain-shaped folding portions configuring the gore portions are second mountain-shaped maintenance portions formed in a triangular shape in which a contact area between the inner surfaces of the facing films is gradually widened.

5. The liquid vessel according to claim 1, wherein the contained liquid is ink and the liquid vessel is mounted in an inkjet recording apparatus to be used as an ink vessel for supplying the ink to the recording apparatus.

6. A method of manufacturing a liquid vessel, the method comprising:

forming gore portions by forming a pair of mountain-shaped folding portions folded in a longitudinal direction at opposed side surfaces of a body portion having a tubular shape obtained by adhering both ends of one film to each other and by forming a valley-shaped folding portion between the pair of mountain-shaped folding portions;

forming mountain-shaped maintenance portions which maintain a state in which inner surfaces of facing films at least partially contact each other;

sealing an opening in a state in which a liquid lead-out portion for directing liquid out is inserted into the opening of the body portion;

filling the liquid in a vessel portion formed by sealing the opening; and sealing another opening of the body portion in a state in which the liquid is filled in the vessel portion.

7. The liquid vessel according to claim 4, wherein the second mountain-shaped maintenance portions are formed by thermally welding the inner surfaces of the facing films to each other.

8. The method of manufacturing a liquid vessel according to claim 6, further including forming second mountain-shaped maintenance portions in a triangular shape in which a contact area between inner surfaces of the facing films is gradually widened.

9. The liquid vessel according to claim 1, wherein the first sealing portion is one of the mountain-shaped folding portions.

10. The method of manufacturing a liquid vessel according to claim 6, wherein the first sealing portion is one of the mountain-shaped folding portions.

11. The method of manufacturing a liquid vessel according to claim 6, wherein the mountain-shaped maintenance portions are formed intermittently in a longitudinal direction of the mountain-shaped folding portions.

12. The liquid vessel according to claim 1, wherein the mountain-shaped maintenance portions are formed in substantially a middle portion of the longitudinal direction of the mountain-shaped folding portions.

13. The method of manufacturing a liquid vessel according to claim 6, wherein the mountain-shaped maintenance portions are formed in substantially a middle portion of the longitudinal direction of the mountain-shaped folding portions.

14. The liquid vessel according to claim 1, wherein the mountain-shaped maintenance portions are formed by clips.

15. The method of manufacturing a liquid vessel according to claim 6, wherein the mountain-shaped maintenance portions are formed by clips.

* * * * *